US011817243B2

(12) United States Patent
Schaefer et al.

(10) Patent No.: US 11,817,243 B2
(45) Date of Patent: Nov. 14, 2023

(54) INDUCTIVE COMPONENT AND HIGH-FREQUENCY FILTER DEVICE

(71) Applicant: Robert Bosch GmbH, Stuttgart (DE)

(72) Inventors: Jannik Robin Schaefer, Wädenswil (CH); Dominik Bortis, Zürich (CH); Johann W. Kolar, Zürich (CH)

(73) Assignee: Robert Bosch GmbH, Stuttgart (DE)

( * ) Notice: Subject to any disclaimer, the term of this patent is extended or adjusted under 35 U.S.C. 154(b) by 554 days.

(21) Appl. No.: 16/981,731

(22) PCT Filed: Mar. 1, 2019

(86) PCT No.: PCT/EP2019/055145

§ 371 (c)(1),
(2) Date: Sep. 17, 2020

(87) PCT Pub. No.: WO2019/179749

PCT Pub. Date: Sep. 26, 2019

(65) Prior Publication Data

US 2020/0411222 A1 Dec. 31, 2020

(30) Foreign Application Priority Data

Mar. 22, 2018 (DE) ..... 10 2018 204 366.3

(51) Int. Cl.
*H01F 17/00* (2006.01)
*H01F 1/34* (2006.01)

(52) U.S. Cl.
CPC ..... *H01F 17/0006* (2013.01); *H01F 1/344* (2013.01); *H01F 2017/0066* (2013.01)

(58) Field of Classification Search
CPC ..... H01F 17/0006; H01F 1/344; H01F 2017/0066
See application file for complete search history.

(56) References Cited

U.S. PATENT DOCUMENTS 9,947,450 B1 * 4/2018 Peck, Jr. ..... H01F 17/06
2009/0079529 A1 * 3/2009 Knott ..... H01F 41/046 336/110

(Continued)

FOREIGN PATENT DOCUMENTS

CN 101443863 A 5/2009
CN 101809457 A * 8/2010 ..... G01R 15/207

(Continued)

OTHER PUBLICATIONS

International Search Report for Application No. PCT/EP2019/055145 dated Jun. 25, 2019 (English Translation, 2 pages).

*Primary Examiner* — Marlon T Fletcher
*Assistant Examiner* — Matthew T Sarles
(74) *Attorney, Agent, or Firm* — Michael Best & Friedrich LLP

(57) ABSTRACT

The invention relates to an inductive component having a planar conductive track structure. The planar conductive track structure is surrounded along a predetermined section by a ferromagnetic core. For targeted control of the current flow inside the planar conductive track structure and, in particular, of the current density in the cross-section of the planar conductive track structure, gaps are provided in a targeted manner in the ferromagnetic core. The gaps in the ferromagnetic core are arranged in regions above and/or below the planar conductive track structure.

10 Claims, 4 Drawing Sheets

(56) References Cited

U.S. PATENT DOCUMENTS

| | | | | |
|---|---|---|---|---|
| 2014/0159499 | A1* | 6/2014 | Dobbs | H01F 41/00<br>307/104 |
| 2016/0322152 | A1* | 11/2016 | Ohashi | H01F 17/06 |

FOREIGN PATENT DOCUMENTS

| | | | | |
|---|---|---|---|---|
| CN | 101809457 | A | 8/2010 | |
| DE | 102006022785 | | 11/2007 | |
| DE | 102006022785 | A1 * | 11/2007 | H01F 17/0013 |
| EP | 3089178 | A1 * | 11/2016 | H01F 17/06 |
| FR | 2750769 | A1 * | 1/1998 | G01R 33/09 |
| WO | 0031760 | | 6/2000 | |
| WO | 2004030001 | | 4/2004 | |
| WO | WO-2017197550 | A1 * | 11/2017 | H01F 21/00 |
| WO | WO-2018041402 | A1 * | 3/2018 | G01L 1/125 |

* cited by examiner

INDUCTIVE COMPONENT AND HIGH-FREQUENCY FILTER DEVICE

BACKGROUND OF THE INVENTION

The present invention relates to an inductive component. The present invention further relates to a high-frequency filter device having an inductive component of this type.

In electronic circuits, inductances which are rated for high currents and high frequencies are frequently produced as separate components and are then affixed to a circuit board by soldering. In the interests of optimization, it is desirable that, in the case of inductive components, windings in the form of copper strip conductors should also be integrated directly in a circuit board Printed publication WO 2004/030001 A1 discloses a high-frequency choke coil for circuit boards, having an inductance and a parallel-connected ohmic resistor. The inductance can be constituted in the form of a meander-shaped printed conductor.

In applications involving high frequencies, on the grounds of the "skin effect", electric current at a rising frequency only flows in an edge region of the electrical conductor. Consequently, in printed electrical circuits for higher-frequency applications, only the edge region of printed conductors is available to accommodate an electric current flux.

SUMMARY OF THE INVENTION

The present invention discloses an inductive component, and a high-frequency filter device.

Accordingly, it is provided as follows:

an inductive component having a planar printed conductor structure and a ferromagnetic core. The planar printed conductor structure comprises an upper side, and an underside which is arranged opposite said upper side. The ferromagnetic core is arranged around the planar printed conductor structure. In particular, the ferromagnetic core incorporates at least one gap in the region of the upper side and/or underside of the planar printed conductor structure.

The planar printed conductor structure preferably assumes a longitudinal extension which is oriented in the direction of a desired current flux through the planar printed conductor structure. The planar printed conductor structure preferably assumes a lateral extension which is oriented perpendicularly to the direction of the desired current flux through the planar printed conductor structure. A diagonal of the cross-section of the ferromagnetic core is oriented perpendicularly to the direction of the desired current flux. The ferromagnetic core, which preferably assumes a tubular or annular configuration, is thus at least partially arranged along the longitudinal extension of the planar printed conductor structure, around said planar printed conductor structure. In the present description, the term "tubular" or "annular", in addition to rectangular or polygonal cross-sections, also preferably includes round or oval cross-sections.

It is further provided as follows:

A high-frequency filter device having an inductive component according to the invention.

The present invention is based upon the knowledge that, in the case of high-frequency electric currents flowing in an electrical conductor, on the grounds of the skin effect, the current flux is increased in the outer region of the electrical conductor only. The present invention is further based upon the knowledge that, by means of magnetic cores having an air gap, on the grounds of the non-uniform distribution of a magnetic field dictated by said air gap, a partial current displacement within an electrical conductor can likewise be achieved.

The present invention is thus based upon a concept whereby this knowledge is taken into consideration in order to provide an arrangement for an inductive component which also shows a high current-carrying capacity for high-frequency electric currents. To this end, an arrangement is provided which is comprised of a planar electrical conductor and a ferromagnetic core which encloses said electrical conductor, wherein the current displacement effects associated with a gap in the ferromagnetic core counteract the current displacement effects associated with the skin effect. It is thus possible, in the case of planar printed conductor structures, for the electric current flux to be distributed over an extensive region of the cross-section of the electrical conductor. In this manner, the current-carrying capacity of the planar electrical conductor can be increased.

Initially, a planar printed conductor structure can be understood as any type of printed conductor structure having a cross-sectional surface which is perpendicular to the intended current flux direction, the extension of which in one direction is significantly greater than the extension thereof in a further direction which is oriented perpendicularly thereto. In particular, the difference between the two extensions can be equal to at least one order of magnitude or more. Planar printed conductor structures can be understood, for example, as printed conductor structures on a circuit board substrate. For example, an electrically conductive material such as, for example, copper or similar can be applied to the circuit board substrate, and configured in accordance with a desired printed conductor structure. Moreover, however, any other planar printed conductor structures can also be understood as planar printed conductor structures. In particular, it is not necessary for the planar printed conductor structures to be applied to a full-surface carrier substrate. In principle, it is also possible for the planar printed conductor structures to be supported only partially, for example at supporting points.

In a simple case, the planar printed conductor structure can be comprised, for example, of a linearly-oriented and planar electrically conductive element. Moreover, however, the planar printed conductor structure can also be constituted in the form of a coil-type printed conductor structure having an arbitrary number of two or more turns. The individual turns, as described in greater detail hereinafter, for example, can be arranged next to one another or one on top of another. A combination of these arrangements is also possible.

The upper side and underside of the planar printed conductor structure are particularly to be understood as those sides of the printed conductor structure which assume the greater, and particularly the greatest extension perpendicularly to the desired electric current flux. The upper side of the printed conductor structure is arranged opposite the underside of the printed conductor structure. In the case of a rectangular cross-section of the printed conductor structure, for example, the upper side and the underside of said printed conductor structure can be mutually interconnected in each case by means of two lateral faces.

The planar printed conductor structure is enclosed by the ferromagnetic core along a predefined section. The ferromagnetic core can at least virtually enclose the planar printed conductor structure about its full circumference. However, the circumference of the ferromagnetic core incorporates one or more gaps. This gap or these gaps are particularly arranged in the region of the upper side and/or the underside of the planar printed conductor structure. By the expression "in the region of" the upper side or underside, it is to be understood that a virtual line, which can be oriented perpendicularly to the upper side or underside, also runs through any such gap. Any such gap in the region of the upper side or underside of the planar printed conductor structure is thus clearly distinguished from gaps which are arranged laterally on a planar printed conductor structure. A ferromagnetic core of an inductive component according to the present invention preferably incorporates no such lateral gaps in the region of the lateral faces of the planar printed conductor structure.

The ferromagnetic core can be constituted of any ferromagnetic material. Ferromagnetic materials of this type are known and, in consequence, will not be described in greater detail here.

As described in greater detail hereinafter, the gap in the ferromagnetic core can be an air gap, or a gap which is at least partially filled with a dielectric material.

The ferromagnetic core can incorporate gaps, both in the region of the upper side and in the region of the underside of the planar printed conductor structure. In particular, the arrangement of one or more gaps in the region of the upper side of the printed conductor structure and in the region of the underside of the printed conductor structure can be executed in an identical, or at least an approximately identical manner. In principle, however, different embodiments with one or more gaps in the region of the upper side or the underside of the planar printed conductor structure are furthermore also possible.

According to one form of embodiment, the ferromagnetic core comprises a plurality of gaps. In particular, a plurality of gaps can be respectively provided, both in the region of the upper side and in the region of the underside. The individual gaps can respectively assume, for example, an identical gap width. Moreover, the gap width of individual gaps can also be varied in accordance with further requirements. By the provision of a plurality of gaps, in particular, a magnetic flux setting can be achieved which further improves the uniform distribution of the current flux within the planar printed conductor structure.

According to one form of embodiment, the planar printed conductor structure can comprise a plurality of parallel-oriented printed conductors. Each of these individual parallel-oriented printed conductors can likewise assume a planar structure, wherein the cross-section of such a printed conductor structure in one spatial direction is significantly greater than the cross-section thereof in a spatial direction which is oriented perpendicularly thereto. By the employment of a plurality of printed conductors, in particular, an increased inductance of the inductive component can be achieved.

According to one form of embodiment, the planar printed conductor structure comprises a plurality of printed conductors which are arranged one on top of another. By the expression "one on top of another", it is to be understood that, in each case, the underside of one printed conductor and the upper side of an adjoining printed conductor are arranged in mutual opposition, with spacing. The individual printed conductors, for example, can be spaced from one another by means of an electrically insulating substrate. In this manner, a coil arrangement having a plurality of turns can be achieved. According to one form of embodiment, the planar printed conductor structure can comprise a plurality of coplanar printed conductors. In a coplanar arrangement of this type, a plurality of, a plurality of particularly parallel-oriented printed conductors are arranged in a common plane. For example, the individual printed conductors can be arranged on a common carrier substrate. It is understood that the arrangement of a plurality of printed conductors configured in a coplanar arrangement and the arrangement of a plurality of printed conductors arranged one on top of another, as described above, can also be mutually combined.

According to one form of embodiment, in particular in a coplanar arrangement of a plurality of printed conductors, at least one gap is arranged in the region of the upper side and/or the underside of each printed conductor. In this manner, for each printed conductor in the printed conductor structure, the most uniform current distribution possible can be achieved within the respective printed conductor.

According to one form of embodiment, at least one gap in the ferromagnetic core can be at least partially filled with a dielectric filler material. In particular, all the gaps in the ferromagnetic core can also be filled with the same filler material. However, different filler materials for the individual gaps are also possible. By the employment of an appropriate filler material, the magnetic flux can be influenced and, as a result, current distribution within the planar printed conductor structure can be controlled. Moreover, by the employment of a filler material, the assembly, and particularly the magnetic core, can also be mechanically stabilized.

According to one form of embodiment, the ferromagnetic core incorporates rounded edges at the transition to the gap. By the rounding of edges in the ferromagnetic core, and particularly by the employment of rounded edges in the region of the gaps, it is also possible for an influence upon the magnetic field, and thus an influence upon current distribution within the planar printed conductor structure to be achieved.

According to one form of embodiment, the magnetic core incorporates a material with ferromagnetic powder particles in the region of the upper side and/or the underside of the planar printed conductor structure. By the partial employment of ferromagnetic powder particles of this type, the magnetic flux can also be influenced. In particular, magnetic cores with ferromagnetic particles of this type are also known as powder cores or cores with a "distributed" air gap.

According to one form of embodiment, the inductive component comprises a carrier substrate. In particular, the planar printed conductor structure can be connected at its underside and/or upper side to a dielectric carrier substrate. For example, the dielectric carrier substrate can be a circuit board substrate for printed circuits. By this arrangement, for example, a planar printed conductor structure can be produced in a particularly simple manner. In particular, laminated structures comprised of a plurality of carrier substrates and/or a plurality of planar printed conductor structures are also possible.

The above-mentioned configurations and further developments can be mutually combined in an arbitrary manner, insofar as this is rational. Other configurations, further developments and implementations of the invention also include combinations, which are not explicitly specified, of characteristics of the invention described heretofore or hereinafter with reference to the exemplary embodiments. In particular, a person skilled in the art will also be able to add individual aspects by way of improvements or additions to the respective basic forms of the invention.

BRIEF DESCRIPTION OF THE DRAWINGS

The present invention is described in greater detail hereinafter with reference to the forms of embodiment represented in the schematic figures of the drawings. In the drawings.

DETAILED DESCRIPTION

In the following description, identical or similar components are identified by the same reference symbols. Moreover, the forms of embodiment described hereinafter, insofar as this is rational, can be mutually combined in an arbitrary manner.

Figure 6:
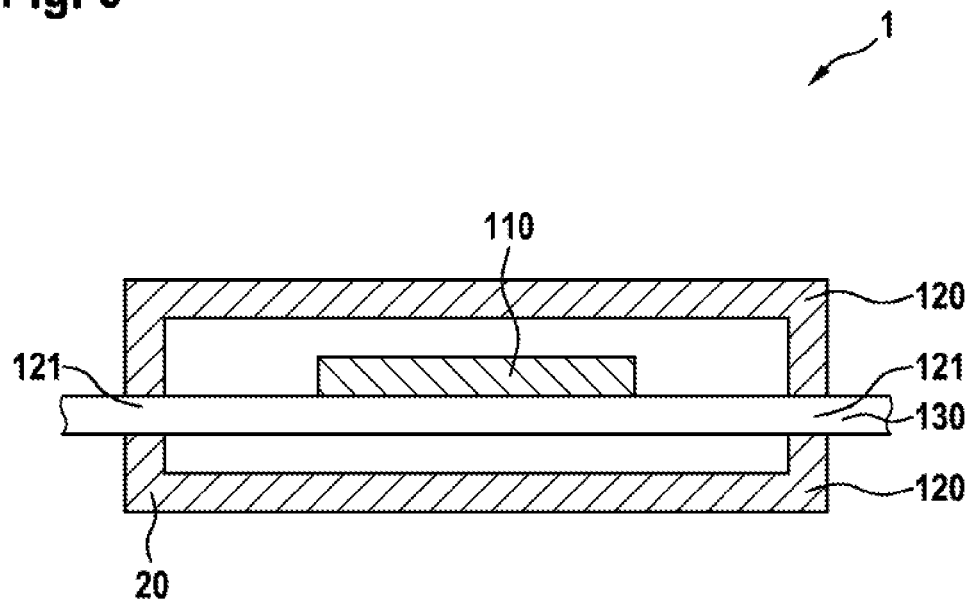
FIG. 6: shows a schematic representation of a cross-section of a conventional component.

FIG. 6 shows a cross-section of an arrangement for an inductive component. An electrically conductive printed conductor structure 110 is fitted to a carrier substrate 130. This can involve, for example, a printed conductor on a circuit board substrate. The height h of the printed conductor structure 110 is significantly smaller than the width b of the printed conductor structure 110. The printed conductor structure 110 is enclosed by two half-shells 120, which are intended to constitute a magnetic core. On the grounds of the continuity of the carrier substrate 130, the core constituted by the two half-shells 120 is interrupted at the positions 121. Consequently, at the positions 121, the magnetic core respectively incorporates a gap, which increases the magnetic field strength in this region.

In an arrangement represented according to FIG. 6, the orientation of the magnetic field lines associated with the position of the gap 121 in the magnetic core results in a current displacement in the printed conductor 110 towards the edges of the printed conductor structure 110.

If, moreover, a high-frequency electric current is fed through the electrical conductor 110, the current flux is likewise displaced into the edge regions of the electrical conductor 110. The maximum current-carrying capacity is significantly reduced as a result.

Figure 1:
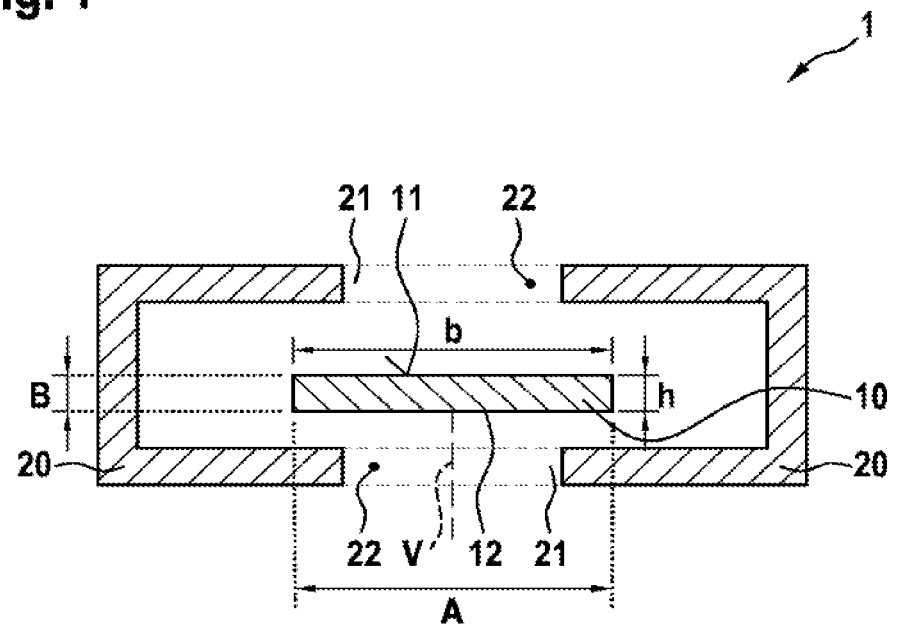
FIG. 1: shows a schematic representation of a cross-section of an inductive component according to one form of embodiment.

FIG. 1 shows a schematic representation of a cross-section of an inductive component 1 according to one form of embodiment. The inductive component 1 comprises a planar printed conductor structure 10 and a ferromagnetic core 20. The cross-section of the planar printed conductor structure 10 assumes a height h which is significantly smaller than the width b of the planar printed conductor structure. The width b lies in the direction of the transverse extension of the planar printed conductor structure 10. In particular, the width b can be greater than the height h by more than one order of magnitude, i.e. by a factor of 10. Along a predefined section in the direction of the longitudinal extension of the printed conductor structure 10, said planar printed conductor structure 10 is enclosed by a ferromagnetic core 20. The ferromagnetic core 20 can be constituted of any ferromagnetic material.

In particular, the planar printed conductor structure 10 comprises an upper side 11 and an underside 12 which is arranged opposite the upper side 11. The upper side 11 and the underside 12 are those sides which assume the larger dimensions, in this case, consequently, the width b, which is significantly greater than the height h. The printed conductor structure 10 can be constituted, for example, of any electrically conductive material, e.g. of copper. For example, the planar printed conductor structure 10 can be configured as a printed conductor structure of a printed circuit. Moreover, however, any other planar printed conductor structures are possible.

The ferromagnetic core 20, which encloses the planar printed conductor structure 10 in a predefined section, incorporates at least one gap 21. The gap or gaps 21 are arranged in a region A of the upper side 11 and/or the underside 12. By this, it is to be understood that, for example, a virtual and notional line V, which is perpendicular to the upper side 11 or the underside 12, runs through the corresponding gap 21. For example, in FIG. 1, a virtual line of this type is represented as a broken line V.

Conversely to FIG. 6, the inductive component 1 expressly incorporates no gap in region B of the lateral faces, i.e. in the region of those faces which interconnect the upper side 11 and the underside 12.

As a result of the gaps 21 in region A of the upper side 11 or the underside 12 of the planar printed conductor structure 10, inconsistencies occur in the magnetic field characteristic, which can influence the current flux through the planar printed conductor structure 10. In particular, as a result of these inconsistencies in the magnetic field, the current flux is at least partially displaced away from the edge towards the center of the planar printed conductor structure 10. Particularly in the case of high-frequency signals, this counteracts any skin effect, as a result of which the electric current flux would be displaced towards the outer surface. Accordingly, by the targeted positioning and arrangement of gaps 21 in the ferromagnetic core 20, an electric current flux can be achieved in the planar printed conductor structure 10 which also encompasses the inner region of said planar printed conductor structure 10. In particular, the electric current flux can be displaced away from the edge region into the inner region of the planar printed conductor structure 10. In this manner, the current-carrying capacity of the planar printed conductor structure 10 can be increased.

Optionally, the gap 21 in the ferromagnetic core 20 can be filled with a dielectric filler material 22. By the selection of an appropriate dielectric filler material 22, an influence can also be exerted upon the magnetic field line characteristic, and thus upon current distribution within the planar printed conductor structure 10. Where a plurality of gaps 21 are present in the ferromagnetic core 20, the individual gaps 21 can either be filled with the same filler material 22 or, optionally, different dielectric filler materials 22 can also be employed for the individual gaps 21.

Moreover, the edges of the ferromagnetic core 20 can be rounded in the region of the transition to the gaps 21.

Figure 2:
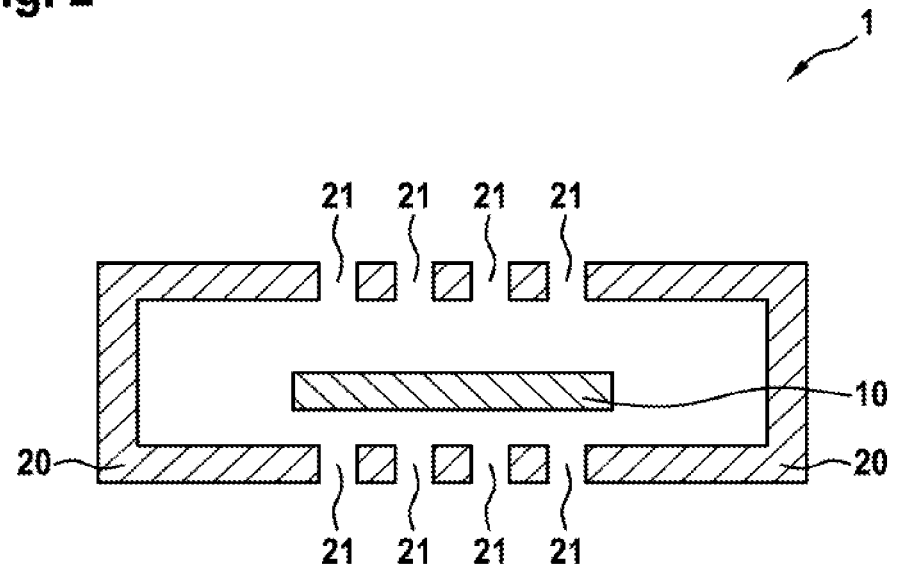
FIG. 2: shows a schematic representation of a cross-section of an inductive component according to a further form of embodiment.

FIG. 2 shows a schematic representation of a cross-section of an inductive component 1 according to a further form of embodiment. The form of embodiment represented in FIG. 2 particularly differs from the above-mentioned form of embodiment in that, instead of a single gap 21 in region A of the upper side 11 or the underside 12 of the planar printed conductor structure 10, a plurality of gaps 21 are present in this case. However, the number of four gaps 21 represented here is an arbitrary example only. Moreover, any other arbitrary number of gaps 21 on the upper side and/or underside of the planar printed conductor structure 10 is also possible. It should also be observed that gaps 21, as represented here, can be incorporated both in the region of the upper side 11 and in the region of the underside 12. In principle, however, it is also possible for gaps 21 to be provided only in the region of the upper side 11 or, alternatively, only in the region of the underside 12.

Figure 3:
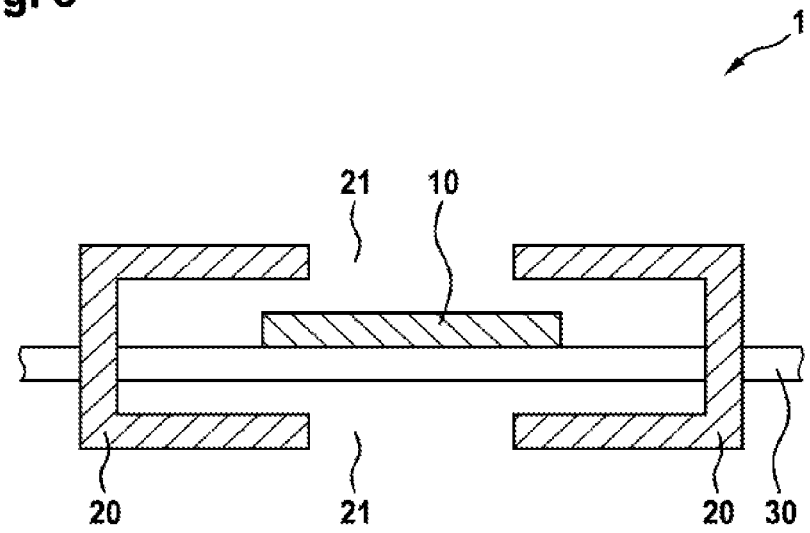
FIG. 3: shows a schematic representation of a cross-section of an inductive component according to one further form of embodiment.

FIG. 3 shows a schematic representation of a cross-section of an inductive component 1 according to one further form of embodiment. The exemplary embodiment represented here particularly differs from the above-mentioned exemplary embodiment, in that the planar printed conductor structure 10 is arranged on an electrically insulating carrier substrate 30. In particular, one side of the planar printed conductor structure 10, in this case particularly the underside 12 of the planar printed conductor structure 10, is connected to one side of the carrier substrate 30.

In addition to the form of embodiment of a planar printed conductor structure 10 represented here, moreover, arrangements having a plurality of printed conductors are also possible. For example, planar printed conductors can be arranged respectively on two opposing sides of the carrier substrate 30. Moreover, for example, a laminated structure comprised of a plurality of carrier substrates 30 and, optionally, a plurality of planar printed conductors is also possible. Optionally, a plurality of printed conductors can also be arranged next to one another on the carrier substrate 30 to constitute a planar printed conductor structure 10.

Figure 4:
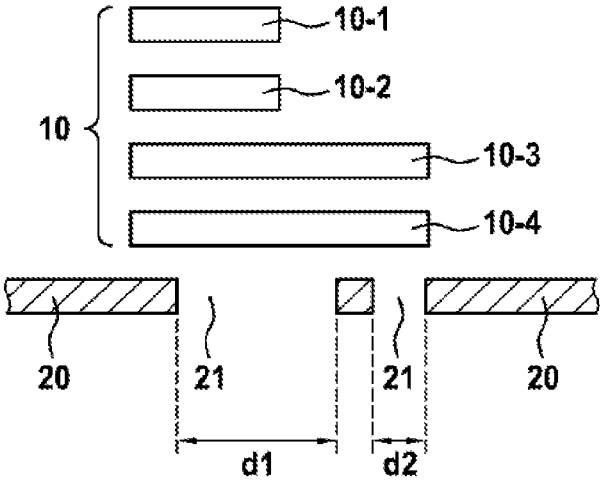
FIG. 4: shows a schematic representation of a cross-section of a subregion of an inductive component according to one form of embodiment.

FIG. 4 shows a schematic representation of part of an inductive component 1 according to a further form of embodiment. As can be seen in the exemplary embodiment represented here, the planar printed conductor structure 10 can comprise a plurality of individual printed conductors 10-*i*. These individual printed conductors 10-*i*, for example, can be arranged one on top of another. In this context, the term one on top of another signifies, for example, that the underside of a printed conductor 10-1 in each case faces an upper side of an adjoining printed conductor 10-1. Moreover, the individual printed conductors 10-*i* in the printed conductor structure 10 can also assume different dimensions. For example, the upper two printed conductors 10-1 and 10-2 have a smaller width than the printed conductors 10-3 and 10-4 which are arranged thereunder. Additionally, it is also possible for a plurality of printed conductors 10-*i* to be arranged next to one another in a common plane. In this manner, for example, a coplanar printed conductor arrangement 10 can be achieved.

As can moreover be seen from the example according to FIG. 4, the width d1, d2 of the gaps 21 can vary. For example, the width d1, d2 of the gaps 21 can be adapted in accordance with the respective printed conductor structure 10. Thus, for example, in the event of a higher number of printed conductors 10-*i*, or of printed conductors 10-*i* in which a higher current density is anticipated, a greater gap width d1 can be selected, whereas, in the event of a lower number of printed conductors 10-*i*, or where the anticipated current density is lower, a smaller gap width d2 can be set. Moreover, for example, the number of gaps 21, in accordance with the configuration of the printed conductor structure 10, can also be varied over the width thereof. In this manner, in accordance with the properties of the planar printed conductor structure 10, the density of gaps 21 in the ferromagnetic core 20 can be varied.

Figure 5A:
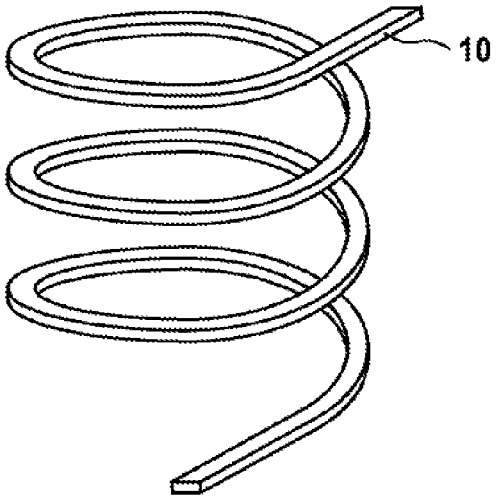
FIGS. 5*a*, 5*b*: show a perspective representation of an inductive component according to a further form of embodiment.
Figure 5B:
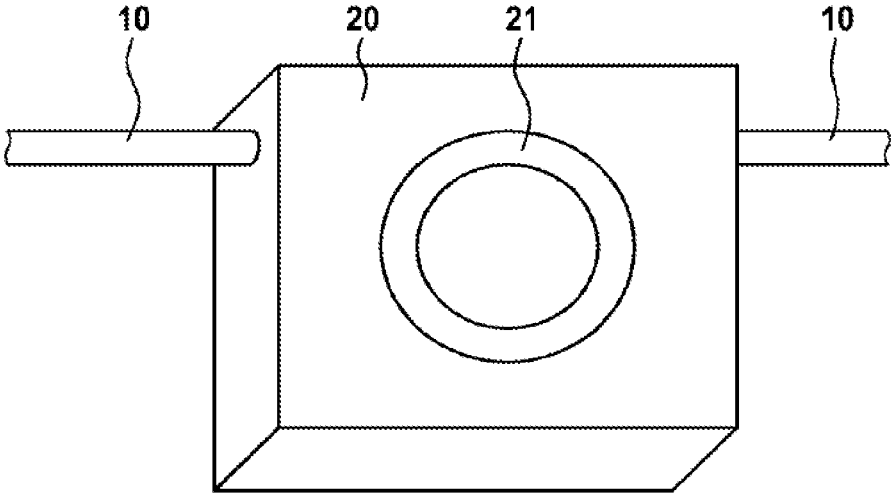

FIGS. 5*a* and 5*b* show a perspective representation of an inductive component 1 according to one form of embodiment. The planar printed conductor structure 10 is represented in the partial illustration 5*a*. The planar printed conductor structure 10 comprises a plurality of turns. In the partial illustration 5*b*, it is further represented how the planar printed conductor structure 10 can be enclosed by a ferromagnetic core 20. This ferromagnetic core 20 can, for example, according to the profile of the planar printed conductor structure 10, incorporate one or more gaps 21. In this manner, the current flux characteristic within the planar printed conductor structure 10 can be deliberately influenced. Consequently, in accordance with the annular profile of the printed conductor structure 10 in the present exemplary embodiment, the gap 21 in the ferromagnetic core 20 also assumes an annular configuration.

The above-mentioned inductive component 1 can be employed, for example, as an inductive filter component for a high-frequency filter device. Optionally, to this end, the above-mentioned inductive component 1 can be combined with further components such as, for example, an ohmic resistor and/or a capacitive component.

In summary, the present invention relates to an inductive component having a planar printed conductor structure. The planar printed conductor structure is enclosed by a ferromagnetic core along a predefined section. For the targeted control of the current flux within the planar printed conductor structure, and particularly of the current density in a cross-section of the planar printed conductor structure, gaps are deliberately provided in the ferromagnetic core. Gaps in the ferromagnetic core are arranged in regions above and/or below the planar printed conductor structure.

What is claimed is:

1. An inductive component (1), having:

a planar printed conductor structure (10) which comprises an upper side (11), and an underside (12), wherein the upper side (11) is arranged opposite the underside (12), and a ferromagnetic core (20), which is arranged around the planar printed conductor structure (10), wherein the ferromagnetic core (20) incorporates a plurality of gaps (21) in a region (A) of the upper side (11) and/or underside (12) of the planar printed conductor structure (10), and wherein each of the plurality of gaps (21) is filled with a different dielectric fill material.

2. The inductive component (1) as claimed in claim 1, wherein the planar printed conductor structure (10) comprises a plurality of parallel-oriented printed conductors (10-*i*).

3. The inductive component (1) as claimed in claim 1, wherein the planar printed conductor structure (10) comprises a plurality of printed conductors (10-*i*) arranged one on top of another.

4. The inductive component (1) as claimed in claim 1, wherein the planar printed conductor structure (10) comprises a plurality of coplanar printed conductors (10-*i*), and wherein at least one gap of the plurality of gaps (21) is arranged in the region (A) of the upper side (11) and/or underside (12) of each printed conductor (10-*i*).

5. The inductive component (1) as claimed in claim 1, wherein the magnetic core (20), in the region of the upper side (11) and/or underside (12) of the planar printed conductor structure (10), incorporates a material with ferromagnetic powder particles.

6. The inductive component (1) as claimed in claim 1, having a carrier substrate (30), wherein the underside (11) and/or upper side (12) of the planar printed conductor structure (10) is arranged on the carrier substrate (30).

7. A high-frequency filter device having an inductive component (1) as claimed in claim 1.

8. The inductive component (1) as claimed in claim 1, wherein the different dielectric fill materials are configured to, when filled into respective gaps of the plurality of gaps (21), influence magnetic flux across the planar printed conductor structure (10) to achieve a more uniform current distribution.

9. The inductive component (1) as claimed in claim 1, wherein the ferromagnetic core (20) incorporates a first plurality of the plurality of gaps (21) in a region of the upper side (11) of the planar printed conductor structure (10) and a second plurality of the plurality of gaps (21) in a region of the underside (12) of the planar printed conductor structure (10).

10. An inductive component (1), having:

a planar printed conductor structure (10) which comprises an upper side (11), and an underside (12), wherein the upper side (11) is arranged opposite the underside (12), and a ferromagnetic core (20), which is arranged around the planar printed conductor structure (10), wherein the ferromagnetic core (20) incorporates a first plurality of gaps (21) in a region of the upper side (11) of the planar printed conductor structure (10) and a second plurality of gaps (21) in a region of the underside (12) of the planar printed conductor structure (10), and wherein each of the first plurality of gaps (21) or each of the second plurality of gaps (21) is filled with a different dielectric fill material.

* * * * *